US005704074A

United States Patent [19]

Baldea

[11] Patent Number: 5,704,074

[45] Date of Patent: Jan. 6, 1998

[54] TOILET GAS SUCTION VENT

[76] Inventor: Pavel Baldea, 1B Queen Ter., Berlin, Conn. 06489

[21] Appl. No.: 683,939

[22] Filed: Jul. 19, 1996

[51] Int. Cl.[6] ..... E03D 9/04

[52] U.S. Cl. ..... 4/213; 4/216; 4/219

[58] Field of Search ..... 4/213, 209 R, 4/216, 219

[56] References Cited

U.S. PATENT DOCUMENTS 4,365,361 12/1982 Sanstrom ..... 4/213
5,179,738 1/1993 Sowards ..... 4/213
5,386,594 2/1995 Hilton ..... 4/213
5,388,280 2/1995 Sim ..... 4/213

*Primary Examiner*—David J. Walczak
*Attorney, Agent, or Firm*—Robert S. Smith

[57] ABSTRACT

Apparatus for venting odors from the toilet bowl by using a fan installed on one side of the toilet bowl. The odors are discharged under the toilet in the drain pipe through an appropriate extension ring designed to allow transit of discharged air. Easy installation of the mechanism requires only unbolting the toilet from the floor, placing the extension ring, base extension board and a new wax ring on the drainage flange, rebolting the toilet in place and making the connection to the fan.

4 Claims, 2 Drawing Sheets

TOILET GAS SUCTION VENT

BACKGROUND OF THE INVENTION

The invention relates to a method of venting odors from a room, and particularly from the locations of odorous and infectious air such as: home bathrooms, hotels, restaurants, sport arenas, hospitals, nursing homes and other public bathrooms, incontinent patients, bed pans, special ring pans used in barium enema radiological procedure, diapers and baby cribs, baby changing tables, or any other infectious or odoriferous source. Because suction vents are typically not used it is difficult to remove the contaminating gases in hospital environments (especially in waiting rooms and fluoroscopic rooms where barium enema examinations are performed) in convalescent homes, and in big public bathrooms.

The prior art venting of bathrooms, in commercial establishments, typically use ceiling mounted fans or use deodorant sprays. Ceiling fans require the use of pipes or plastic ducts to carry the vented air outside the building. Mounting of the venting pipes and fans is manageable if installed during the construction of the building. Installation is very difficult in existing buildings. Access to an external ducts extending out of the building is often very difficult. In addition, many fan systems inherently require diffusion of the contaminating gas into substantially the entire room before any contaminating gas is removed. Stated another way, the location of the contaminating gas is often a substantial distance from the inlet to the fan or the inlet to the duct that is connected to the fan. Thus, there will be substantial diffusion throughout the room and into adjacent rooms. More specifically, in many cases, the source of the contaminating gas is a toilet bowl and in many such systems the inlet for the exhaust fan is located much too far from the toilet bowl.

In addition, the prior ad devices are often inefficient because they pull the air coming from a door or window, leaving the odors to float above the toilet area. Yet another inefficiency of the ceiling fan is that it squanders to much energy by venting out an excessive amount of air which was previously heated or cooled to provide a comfortable room temperature. The use of a pleasant smelling deodorant does not eliminate the foul air but instead adds more chemicals to the already contaminated air trapped inside the room. Some existing very, very expensive toilet bowls provide other utilities such as water heating and washing systems.

An object of this invention is to eliminate the embarrassment related to using a bathroom immediately after someone else had used it, to living in the same room with another patient that uses a bed pan, to being in a room when diapers of a baby or adult are changed, to being in the room when a barium enema examination is conducted in a fluoroscopic room as well as in other situations.

It is an object of the invention to provide a method of venting the bathroom by using ducting placed under the toilet seat, so that the odors are vented right from the toilet bowl before disseminating throughout the entire room.

It is another object of the invention to provide a method of saving energy by using a small fan, since a minimal draft is all that is required to remove and eliminate the air from the toilet area.

It is still another object of the invention to provide a method of venting odors from a bathroom at a low investment cost and eliminating a substantial construction project, such as making holes in the walls, floor, or ceiling, which is usually required when installing a ceiling fan.

Yet another object of the invention is to use the venting fan mounted onto the toilet to vent odors from a remote odor source through an extension hose that may be attached to a bed pan, barium enema inflated ring, the diapers of an incontinent patient in his bed, or a baby changing table.

Still another object of the invention is to provide a design of a venting fan that can be used on all types of toilet bowls regardless of the specific form or size thereof.

Another object of the invention is to provide apparatus Having various forms so that some forms may be installed on existing toilet bowls and other forms may be constructed as an integral part of new toilet bowls that include venting systems that are much easier to install.

SUMMARY OF THE INVENTION

It has now been found that these and other objects of the invention may be attained in either (1) a ventilating system apparatus for an associated toilet bowl having an associated toilet seat and an associated soil pipe or (2) a ventilating toilet system that includes an integral toilet and toilet seat having a collar disposed intermediate the toilet bowl and the associated soil pipe. The collar has an opening therein. The apparatus further includes a conduit having a first end and a second end, the first end is dimensioned and configured for insertion intermediate the associated toilet seat and the associated toilet bowl. The second end is dimensioned and configured for insertion into the opening. A fan is disposed in fluid communications with the conduit to urge gases from the first end to the second end.

In some forms of the invention a valve is disposed within the conduit and the valve has an open position allowing free flow of gases from the first end to the second end and a closed position that prevents free flow of gases from the first end to the second end. Some forms of the invention include a switch operatively connected to the fan and causing the fan to operate or not operate. Other forms of the invention include a mechanical linkage connected to the valve mechanism. The mechanical linkage permits manual movement of the valve mechanism from the open position to the closed position and from the closed position to the open position.

The valve mechanism may be a flapper valve and the switch and valve mechanism may be interconnected for simultaneous operation. The mechanical linkage may include a cable and may also include an arm dimensioned and configured for movement within a channel.

In some forms of the invention the cable is attached to the arm and the tension on the cable is varied as the arm is moved in the channel. In some forms of the invention the switch abuts a portion of the arm in at least one position of the arm.

BRIEF DESCRIPTION OF THE DRAWING

The invention will be better understood by referring to the accompanying drawings in which.

DESCRIPTION OF THE PREFERRED EMBODIMENTS

Figure 1:
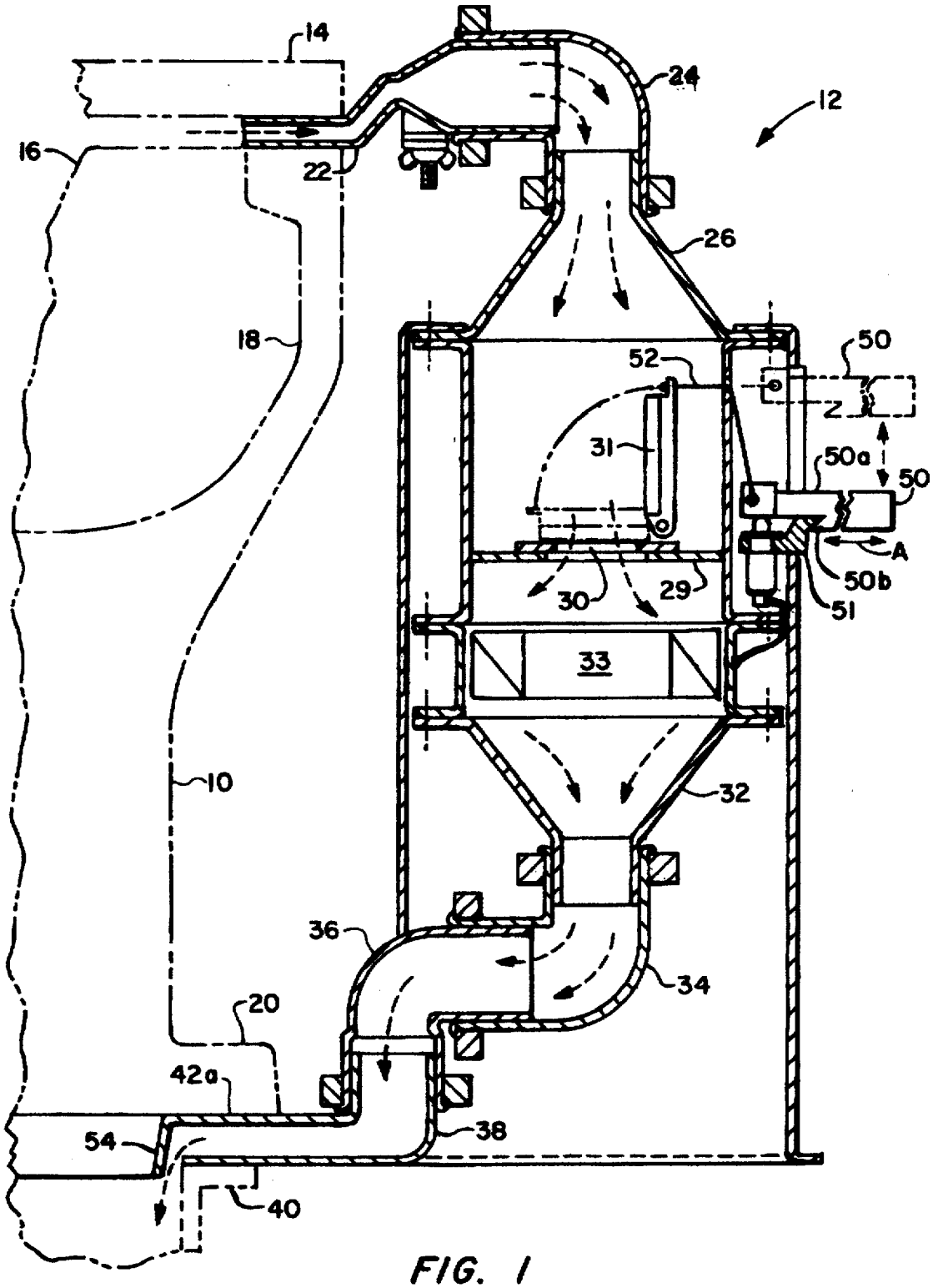
FIG. 1 is a partially schematic vertical cross section of one form of the present invention in which a venting fan connects the interior of the toilet bowl to the soil pipe connected by a spacer to the outlet of the toilet bowl.
Figure 2:
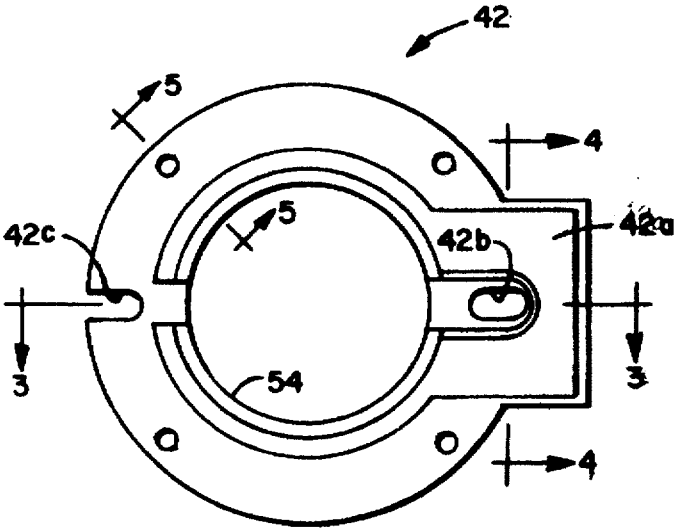
FIG. 2 is a top view of the spacer in accordance with one form of the invention that is placed intermediate the toilet bowl and the soil pipe.
Figure 4:
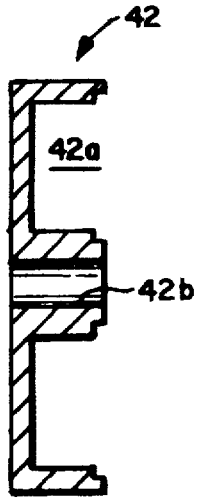
FIG. 4 is a sectional view taken through the line 4—4 of FIG. 2.
Figure 3:
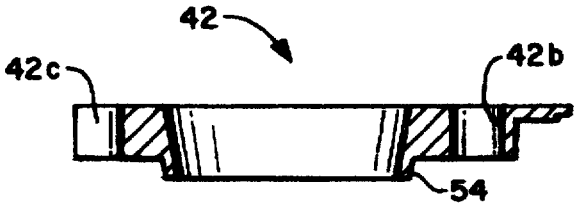
FIG. 3 is a sectional view taken through the line 3—3 of FIG. 2.
Figure 5:
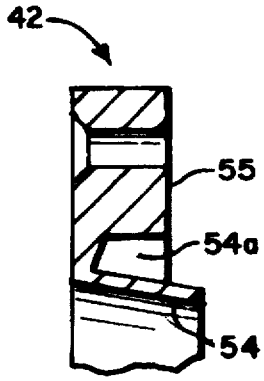
FIG. 5 is a sectional view taken through the line 5—5 of FIG. 2.

Referring now to FIG. 1 there is shown a toilet bowl 10 which cooperates with the ventilating apparatus 12 in accordance with the present invention. It will be understood that the various forms of the present invention may include apparatus in which the ventilating apparatus 12 is installed on an existing toilet bowl 10 as well as new toilet bowl constructions in which the ventilating apparatus 12 is an integral part of a single assembly. FIG. 1 has been simplified and has some parts that are shortened or rotated from their usual position for clarity.

In the conventional manner the toilet bowl 10 includes a seat 14 that is ordinarily spaced with respect to the top surface 16 of the bowl 18. A flange 20 extends around the circumferential extent of the base of the toilet bowl 10. The flange 20 is customarily bolted to a soil pipe with an intervening wax ring 21 to provide positive sealing therebetween.

In the illustrated preferred embodiment of the invention a flattened duct 22 having a height sufficiently small to permit insertion between the seat 14 and the top 16 of the bowl 18 connects the ventilating apparatus 12 to the toilet bowl 10. In the preferred form the duct 22 has a width of about three inches. Although this dimension is satisfactory for many applications it will be understood that other embodiments will use other dimensions. For example the duct 22 might have an annular form that extends around substantially the entire extent of the seat 14. Coupled to the duct 22 is a first elbow 24 that communicates with the duct 22 so that the duct communicates with a funnel shaped. coupling 26 having a flange engaging a housing 27 and an outside covering 28. The housing 27 includes a passageway 27 extending axially within the axially elongated passageway 27, and a laterally extending wall 29 in which is disposed a valve seat 30. Cooperating with the valve seat 30 is a spring loaded flapper 31 dimensioned and configured for selective seating on the valve seat 30. The housing 27 is coupled to the entering side of the fan 33.

A fan 33 is coupled between the passageway 30 and a second funnel member 32. The funnel member 32 is coupled to a second elbow 34. The second elbow 34 is connected to a third elbow 36 which is connected to a fourth elbow 38 which is connected to a collar 42 that extends under the toilet bowl 10 where it is seated between the flange 20 of the toilet bowl 10 and the flange 40 of the soil like 41.

The specific construction of the collar 42 will be more apparent by reference to figures 2,3,4, and 5. The fourth elbow 38 has a flattened shape that is wider than it is high and which is dimensioned and configured for fitting into a channel **42*a* in a collar 42 that is disposed intermediate the flange 20 of the toilet bowl 10 and the flange 40 of the soil pipe 41. Those skilled in the art will recognize that when the toilet is flushed water and waste material will flow through the collar 42 and particularly the central opening therein that is within a truncated conical shaped lip 54. The lip extends around substantially the entire central opening as best seen an FIG. 2. The shape of the lip 54 is most apparent by reference to FIGS. 1 and 5. More particularly, it will be seen that gases flowing through the system including the fan 33 will flow into the soil pipe 41. Those skilled in the art will recognize that the soil pipe 41 stays vented to atmosphere and accordingly there is no fluid pressure within the soil pipe 41 and thus no impediment to the free flow of gases into the soil pipe 41**.

The collar 42 has a opening **42*a* dimensioned and configured for mating engagement with the fourth elbow 38. Thus, the gases are directed into the arcuate channel 54*a* that is defined between the lip 54 and the main body 55 of the collar 42. A wax ring 21 will ordinarily being disposed intermediate the collar and the flange 20 of the toilet bowl 10. The wax ring 21 is conventional to provide a good seal without the need for tightening of bolts securing the toilet bowl flange 20 to the soil pipe flange 40 in a manner that would crush the ceramic toilet bowl flange 20. Ordinarily, only two bolts (not shown) extend respectively through the slot 42*c* and the elongated bore 42*b* to couple the flange 20 to the flange 40**.

Referring again to FIG. 1, when the venting system is not in use the flapper 31 is horizontal and closed. The flapper 31 is spring loaded or biased to the closed position. The structure also includes a generally horizontal arm 50 that is supported for movement up and down in a guide channel 49. In other words, the arm 50 is dimensioned and configured for sliding movement between upper and lower positions as illustrated in FIG. 1. In the normally closed position of the flapper 31, the arm 50 is in the upper position (indicated by dashed lines) and there is no tension in the cable 52 that extends from the arm 50 to the part of the flapper that is most remote from the hinge on which the flapper 31 pivots. It is the upper position, Illustrated in dashed line, in which the tension in the cable 52 is relaxed and the spring loaded flapper 31 is free to move to the horizontal position Illustrated in dashed line.

The arm 50 will ordinarily be manually moved downwardly to the position shown in solid line in FIG. 1 when it is desired to exhaust foul air. When the arm 50 is moved to the lower position manually the tension in the cable 52 is increased and thus the flapper 31 is moved to the vertical position Illustrated in solid line in FIG. 1. In addition, the movement of the arm 50 to the lower position also contracts a button 58 that is part of the switch 56. This contact closes the switch 56 that abuts the arm 50 when the arm 50 is in the lower position. The switch 56 is a momentary switch in the preferred embodiment of the present invention. Thus, movement of the arm 50 to the lower position causes the switch 56 to momentarily supply electrical power to the fan 33 by means of wires, represented schematically by dashed line **56*a*. Electrical power to the fan 33 causes venting of foul gasses through the fan 33**.

The switch 56 is provided with a finger **50*a* that extends from the side of the generally cylindrical switch 56 in the preferred embodiment of the invention. The arm 50 has a lip 50*b* that is dimensioned and configured for selective engagement with the finger 50*a* to hold the arm 50 in the down position and provide continuous power to the fan 33. As indicated by the double ended arrow 50*c* the arm 50 is of telescopic construction so that the operator may lock the lip 50*b* into engagement with the finger 50*a* to provide continuous power to the fan 33**.

The spring bias on the flapper 31 will cause the flapper 31 to move to the closed position if the arm 50 is manually moved upwardly. In the preferred embodiment the spring bias on the flapper 31 is sufficient to move the flapper 31 to the closed position and also to cause the arm 50 to move upwardly in the guide channel 49. This will release the force on the button 58 which will stop electrical power flow to the fan 33.

Figure 6:
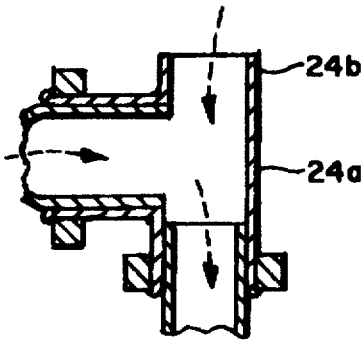
FIG. 6 is a schematic elevational view of an alternate embodiment in which a T-shaped fitting with a branch hose replaces an elbow on the suction side of the fan to facilitate removal of odors other than the odors emanating from the toilet.

One embodiment of the invention achieves the object of venting odors from a remote odor source through an extension hose that may be attached to a bed pan, barium enema inflated ring, the diapers of an incontinent patient in his bed, or a baby changing table by the apparatus shown in which a separate hose **24*b* (shown schematically in FIG. 6) extends from a tee fitting 24*a* that is used in place of the elbow 24 shown in FIG. 1**.

In other variations of the invention, the switch 56 may be replaced with a switch that is actuated by mounting it in the toilet seat and thus, it will be turned on automatically when ever someone sits on the toilet. The switch can also be activated by using an electric sensor mat that completes a circuit whenever someone steps on it. Still another embodiment of the invention utilizes a photo cell that closes a circuit upon detecting motion. In some embodiments the valve can is opened by using an electromagnet that will open it when the switch is activated.

The invention has been described with reference to the illustrated preferred embodiments. Persons skilled in the art of such devices may upon exposure to the teachings herein, conceive other variations. Such variations are deemed to be encompassed by the disclosure, the invention being delimited only by the following claims.

Having thus described my invention, I claim:

1. A ventilating system apparatus for an associated toilet bowl having an associated toilet seat and an associated soil pipe which comprises:

a collar disposed intermediate the associated toilet bowl and the associated soil pipe, said collar having an opening therein;

a conduit having a first end and a second end, said first end being dimensioned and configured for insertion intermediate the associated toilet seat and the associated toilet bowl, said second end being dimensioned and configured for insertion into said opening;

a fan disposed in fluid communications with said conduit to urge gases from said first end to said second end;

a valve disposed within said conduit, said valve having an open position allowing free flow of gases from said first end to said second end and a closed position that prevents free flow of gases from said first end to said second end;

a switch operatively connected to said fan and causing said fan to operate or not operate; and a mechanical linkage connected to said valve mechanism, said mechanical linkage permitting manual movement of said valve mechanism from said open position to said closed position and from said closed position to said open position;

said valve mechanism being a flapper valve, said switch and valve mechanism are interconnected for simultaneous operation, said mechanical linkage including a cable and an arm dimensioned and configured for movement within a channel, said cable is attached to said arm and the tension on said cable is varied as said arm is moved in said channel.

2. The apparatus as described in claim 1 wherein:

said switch abuts a portion of said arm in at least one position of said arm.

3. A toilet with integral ventilating system apparatus for cooperation with an associated soil pipe which comprises:

a toilet bowl and a toilet seat;

a collar disposed intermediate said toilet bowl and the associated soil pipe, said collar having an opening therein;

a conduit having a first end and a second end, said first end being dimensioned and configured for insertion intermediate said toilet seat and said toilet bowl, said second end being dimensioned and configured for insertion into said opening;

a fan disposed in fluid communications with said conduit to urge gases from said first end to said second end;

a valve disposed within said conduit, said valve having an open position allowing free flow of gases from said first end to said second end and a closed position that prevents free flow of gases from said first end to said second end;

a switch operatively connected to said fan and causing said fan to operate or not operate;

a mechanical linkage connected to said valve mechanism, said mechanical linkage permitting manual movement of said valve mechanism from said open position to said closed position and from said closed position to said open position;

said valve mechanism is a flapper valve;

said switch and valve mechanism are interconnected for simultaneous operation;

said mechanical linkage includes a cable;

said mechanical linkage includes an arm dimensioned and configured for movement within a channel and said cable is attached to said arm and the tension on said cable is varied as said arm is moved in said channel.

4. The apparatus as described in claim 3 wherein:

said switch abuts a portion of said arm in at least one position of said arm.

* * * * *